US007221878B2

(12) United States Patent
Chen

(10) Patent No.: US 7,221,878 B2
(45) Date of Patent: May 22, 2007

(54) ALLOWING IMAGE FORMATION USING CONSUMABLE ITEM WHERE CODE OF CONSUMABLE ITEM IS IDENTICAL TO CODE OF IMAGE-FORMATION DEVICE

(75) Inventor: Steven H. Chen, Milpitas, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 100 days.

(21) Appl. No.: 11/061,238

(22) Filed: Feb. 18, 2005

(65) Prior Publication Data

US 2006/0188270 A1 Aug. 24, 2006

(51) Int. Cl.
*G03G 15/00* (2006.01)
*B41J 2/175* (2006.01)

(52) U.S. Cl. ..... 399/12; 399/24; 399/25; 347/86

(58) Field of Classification Search ..... 399/12, 399/13, 24, 25, 26, 27, 80, 109; 347/20, 347/86

See application file for complete search history.

(56) References Cited

U.S. PATENT DOCUMENTS 4,961,088 A * 10/1990 Gilliland et al. ..... 399/25
5,132,729 A * 7/1992 Matsushita et al. ..... 399/24
5,579,088 A * 11/1996 Ko ..... 399/12
6,416,154 B1 7/2002 Silverbrook
6,685,298 B2 2/2004 Walker
2002/0001093 A1 1/2002 Bullock
2003/0031475 A1* 2/2003 Asakura ..... 399/12
2003/0035129 A1 2/2003 Phillips et al.
2003/0053108 A1 3/2003 Clough et al.
2003/0172268 A1 9/2003 Walmsley et al.
2004/0049468 A1 3/2004 Walmsley
2004/0101321 A1 5/2004 Alegria et al.
2004/0249757 A1 12/2004 Walmsley et al.
2005/0163514 A1* 7/2005 Hwang ..... 399/12 X
2005/0243116 A1 11/2005 Ward et al.

FOREIGN PATENT DOCUMENTS

EP 1253552 10/2002

OTHER PUBLICATIONS

European Search Report for Application No. EP06101221.8. Report issued Nov. 7, 2006.

* cited by examiner

*Primary Examiner*—Sandra L. Brase

(57) ABSTRACT

A first code is programmed into a memory of an image-formation device consumable item, outside of an image-formation device. Upon insertion of the image-formation device consumable item into the image-formation device, it is detected that the memory of the consumable item has programmed therein the first code. The image-formation device determines whether the first code is identical to a second code programmed into a memory of the image-formation device. Where the first code is identical to the second code, the consumable item is allowed to be used by the image-formation device to form images on media.

25 Claims, 4 Drawing Sheets

ALLOWING IMAGE FORMATION USING CONSUMABLE ITEM WHERE CODE OF CONSUMABLE ITEM IS IDENTICAL TO CODE OF IMAGE-FORMATION DEVICE

BACKGROUND

Nearly all printing devices, such as inkjet and laser printers, employ consumable items in printing images on media. For instance, inkjet printers typically use inkjet cartridges, whereas laser printers typically use toner cartridges. These consumable items can be expensive. Many times, an organization, such as a person's place of work, a library, or another organization, uses the same types of printing devices that are found in people's homes. As a result, the consumable items employed in these printing devices can be an attractive target for theft.

BRIEF DESCRIPTION OF THE DRAWINGS

The drawings referenced herein form a part of the specification. Features shown in the drawing are meant as illustrative of only some embodiments of the invention, and not of all embodiments of the invention.

DETAILED DESCRIPTION OF THE DRAWINGS

In the following detailed description of exemplary embodiments of the invention, reference is made to the accompanying drawings that form a part thereof, and in which is shown by way of illustration specific exemplary embodiments in which the invention may be practiced. These embodiments are described in sufficient detail to enable those skilled in the art to practice the invention. Other embodiments may be utilized, and logical, mechanical, electrical, electro-optical, software/firmware and other changes may be made without departing from the spirit or scope of the present invention. The following detailed description is, therefore, not to be taken in a limiting sense, and the scope of the present invention is defined only by the appended claims.

Figure 1:
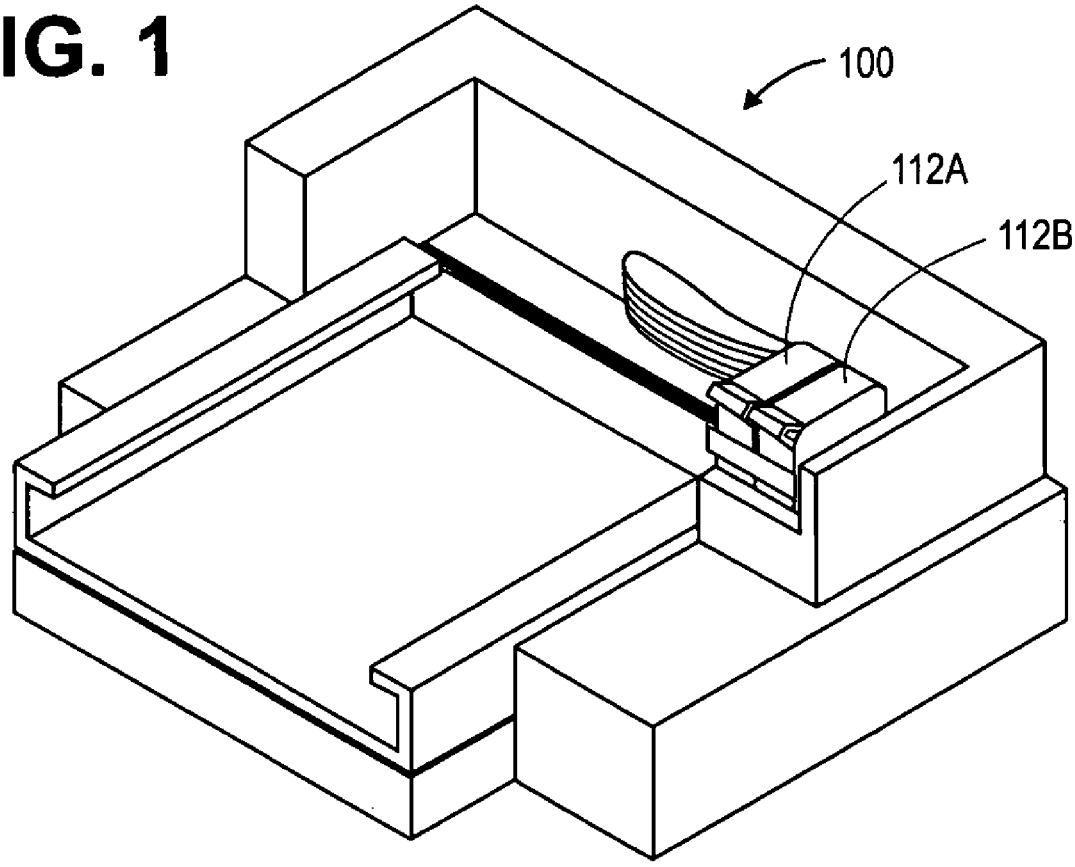
FIG. 1 is a diagram of a representative image-formation device in which image-formation device consumable items are insertable so that the device is able to form images on media, in conjunction with which embodiments of the invention may be practiced.

FIG. 1 shows a representative image-formation device 100, in conjunction with which embodiments of the invention may be practiced. The image-formation device 100 is particularly an inkjet-printing device, such as an inkjet printer. Other types of image-formation devices in conjunction with which embodiments of the invention may be practiced include laser-printing devices, such as laser printers, as well as other types of image-formation devices.

Image-formation device consumable items 112A and 112B, collectively referred to as the consumable items 112, are insertable into the image-formation device 100 so that the device 100 is able to form images on media, such as paper. The consumable items 112 are particularly inkjet cartridges containing supplies of ink and optionally inkjet printheads. Without the consumable items 112, the image-formation device 100 is unable to form images on media. The items 112 are consumable items in that the process of forming images on media depletes, or consumes, the items 112, such that at some point new items 112 have to be inserted into the image-formation device 100 so that image formation can continue on media.

Other types of image-formation device consumable items are also amenable to implementation in conjunction with embodiments of the invention. Such other types of consumable items include ink, colorant, pigment, and toner. Furthermore, other types of consumable item include fusers or fuser assemblies, for use with laser-printing devices, as well as printheads, for use with inkjet-printing devices. As can be appreciated by those of ordinary skill within the art, embodiments of the invention are not limited to a particular type of image-formation device, nor to a particular type of image-formation device consumable item.

Figure 2:
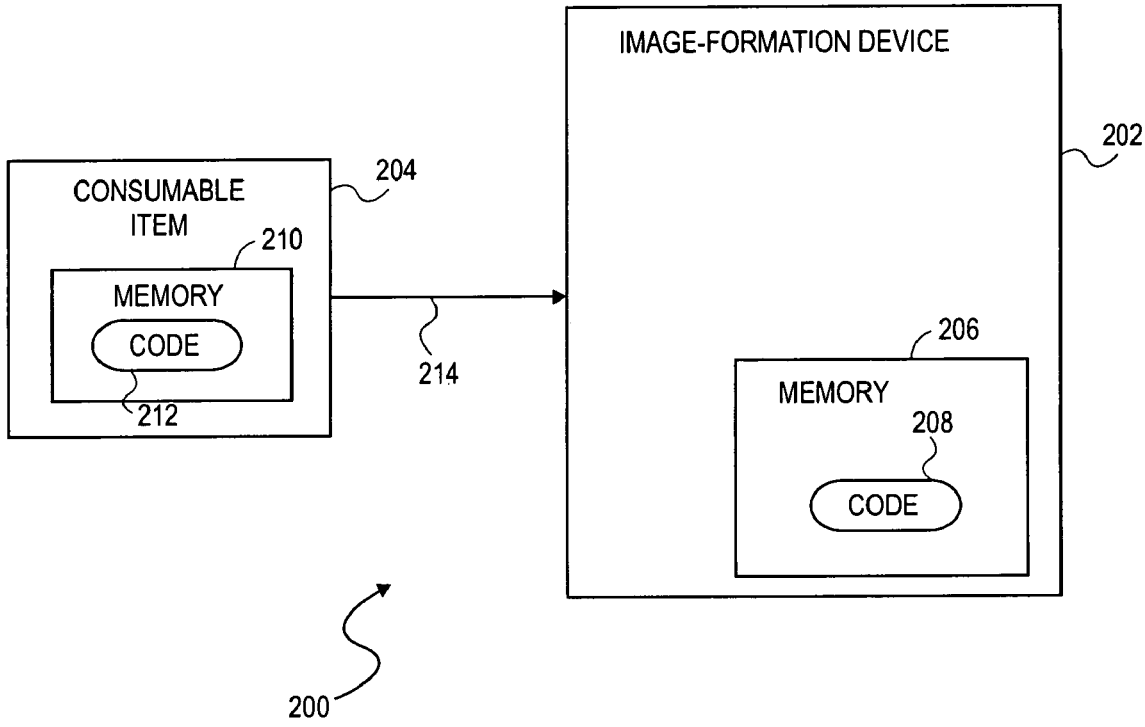
FIG. 2 is a diagram of an image-formation device having a code programmed into a memory thereof and an image-formation device consumable item also having a code programmed into a memory thereof, according to an embodiment of the invention.

FIG. 2 shows a system 200, according to an embodiment of the invention. The system 200 includes an image-formation device 202, and an image-formation device consumable item 204 that is insertable into the device 202, as indicated by the arrow 214. The image-formation device 202 includes a memory 206 having a code 208 programmed therein. The memory 206 is a non-volatile memory, and may in one embodiment be a semiconductor memory, such as flash memory.

The consumable item 204 also includes a memory 210 having a code 212 programmed therein. The memory 210 is a non-volatile memory, and may in one embodiment be a semiconductor memory, such as flash memory. The code 212 is programmed into the memory 210 before the consumable item 204 is inserted into the image-formation device 202. That is, the code 212 is programmed into the memory 210 of the consumable item 204 outside of the image-formation device 202.

When the consumable item 204 is inserted into the image-formation device 202, as indicated by the arrow 214, the image-formation device 202 detects whether the memory 210 of the consumable item 204 has a code 212 programmed therein. If the device 202 detects the code 212 programmed in the memory 210, then the device 202 reads the code 212 from the memory 210 of the item 204. The device 202 compares the code 212 to the code 208 programmed in its own memory 206. If the code 212 is identical to the code 208, then the image-formation device 202 utilizes the consumable item 204 to form images on media.

However, if the code 212 is not identical to the code 208, then the image-formation device 202 does not utilize the consumable item 204 to form images on media. Such code matching provides theft deterrence. For example, a user who knows that the consumable item 204 has the code 212 programmed into the memory 210 thereof, such that the consumable item 204 can only be used within image-formation devices, like the device 202, that have the identical code programmed into memories therein, is less likely to steal the consumable item 204. This is because the consumable item 204 is essentially useless to the prospective thief, because the consumable item 204 is coded to be operable in image-formation devices that are programmed with the same code.

In one embodiment, if the consumable item 204 does not have a code programmed into the memory 210 thereof, but the image-formation device 202 does have a code 208 programmed into the memory 206 thereof, the image-formation device 202 will still use the consumable item 204 to form images on media. In another embodiment, if the image-formation device 202 does not have a code programmed into the memory 206 thereof, but the consumable item 204 does have a code 212 programmed into the memory 210 thereof, the image-formation device 202 will not use the consumable item 204 to form images on media. In a third embodiment, if both the image-formation device 202 and the consumable item 204 do not have codes programmed into their memories 206 and 210, respectively, the image-formation device 202 will still use the consumable item 204 to form images on media.

The code 212 and the code 208, where identical, may be associated with a particular party, such as a particular organization, like a given company or corporation. All of the consumable items purchased by the party may be pre-programmed with the party's code at the time of purchase or at the time of manufacture, by the distributor, merchant, vendor, or manufacturer of the consumable items. Alternatively, the consumable items may be programmable by the party itself, using a specialized or general-purpose programming device for this purpose. Likewise, all of the image-formation devices purchased, leased, or otherwise used by the party may be pre-programmed with the party's code, or may be programmable by the party itself. The codes 208 and 212 are thus capable of being non-unique, in that other image-formation devices, besides the image-formation device 202, may have the same code 208, and other consumable items, besides the consumable item 204, may have the same code 212.

The memory 206, and/or the memory 210, may be reprogrammable or non-reprogrammable. Therefore, in one embodiment, once either the memory 206 or the memory 210 has been programmed with a given code, the code cannot be erased from the memory and the memory cannot be reprogrammed with a new code. In another embodiment, however, once the memory 206 or the memory 210 has been programmed with a given code, the code may be erasable from the memory or the memory may be reprogrammed with a new code. A password or other authentication approach may be employed to ensure that only authorized users are able to erase codes from memory or reprogram new codes into memory.

The programming of the code 212 into the memory 210 of the consumable item 204 before the item 204 is inserted into the image-formation device 202, and outside of the image-formation device 202, is advantageous. Typically within an organization, spare consumable items will be placed in a convenient location near the image-formation device in which they are to be used, so that when the consumable item already in the device is depleted, any person of the organization may switch a new consumable item for the depleted consumable item. Theft is more likely to occur of the spare consumable items that have not yet been used, rather than of the consumable item already in the image-formation device. Therefore, having a code programmed into the memories of the consumable items before they are inserted into the image-formation device ensures that they are less likely to be targets of theft. If a code is programmed into the memory of the consumable item only once the item has been inserted into an image-formation device, then the item is still likely to be a target of theft before it has been inserted into the device, especially where the item is placed in a convenient location near the device, as is common.

Figure 3:
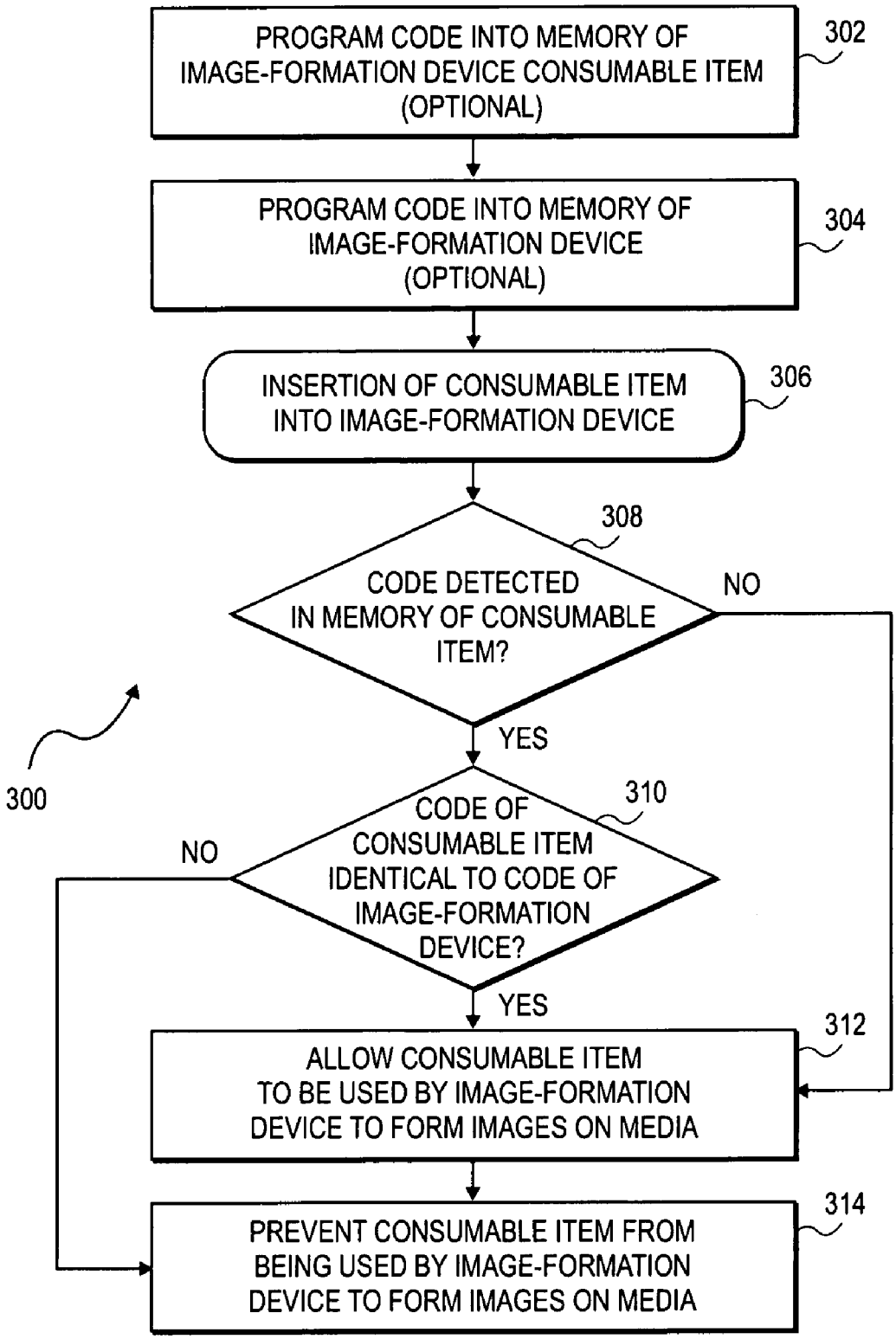
FIG. 3 is a flowchart of a method to determine whether to allow an image-formation device consumable item to be used in an image-formation device to form images on media, according to an embodiment of the invention.

FIG. 3 shows a method 300, according to an embodiment of the invention. At least some parts of the method 300 may be implemented as one or more computer program parts of a computer program stored on a computer-readable medium. The computer program parts may be software objects, subroutines, routines, computer program sections, and the like. The computer-readable medium may be a volatile or a non-volatile medium. The computer-readable medium may further be a semiconductor medium, a magnetic medium, and/or an optical medium, among other types of computer-readable media.

A code is optionally programmed into the memory of an image-formation device consumable item (302). The programming of the code into the memory of the consumable item is performed before the item is inserted into an image-formation device. Furthermore, the programming of the code into the memory of the consumable item is performed outside of the image-formation device. A code is also optionally programmed into the memory of the image-formation device (304). The programming of a code into the image-formation device may be performed before or after a code is programmed into the consumable item. The programming of the codes into the image-formation device and the consumable item may be performed by a user of a particular party with which the codes are associated, or by a merchant of the device and the item upon purchase of the device and the item by the user of the particular party.

The consumable item is then inserted into the image-formation device (306). If a code is detected as having been programmed in the memory of the consumable item (308), then the method 300 determines whether the code of the consumable item is identical to the code, if any, of the image-formation device (310). If so, then the consumable item is allowed to be used by the image-formation device to form images on media (312). Furthermore, if there is no code detected in the memory of the consumable item (308), then the consumable item is also allowed to be used by the device to form images on media (312). However, if the code of the consumable item differs from that of the image-formation device (310), then the consumable item is prevented from being used by the image-formation device to form images on media (314).

Figure 4:
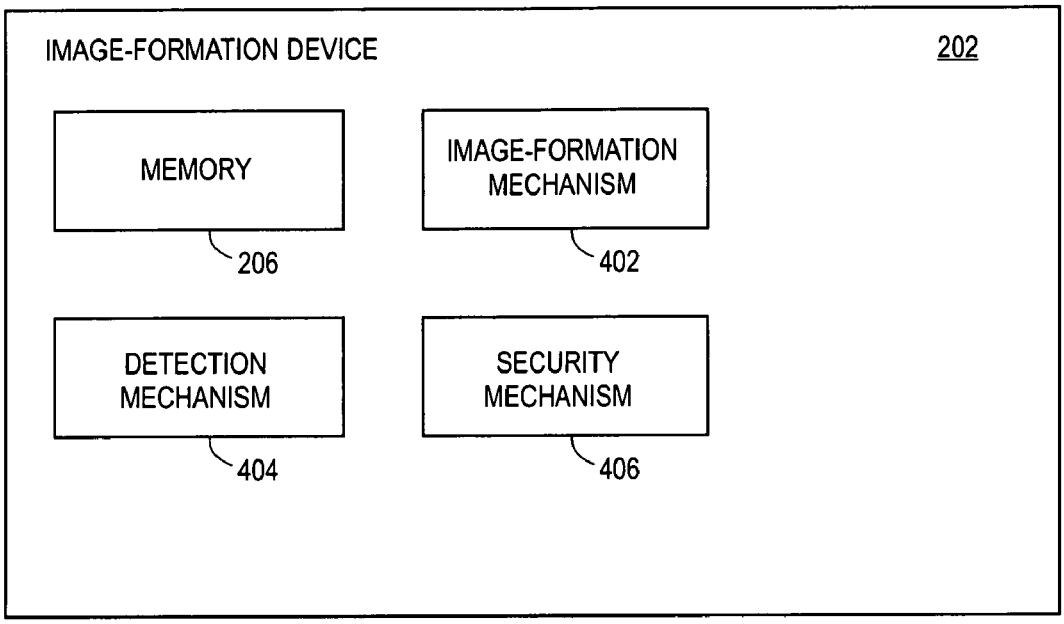
FIG. 4 is a rudimentary block diagram of a particular implementation of an image-formation device, according to an embodiment of the invention.

FIG. 4 shows a rudimentary block diagram of one implementation of the image-formation device 202, according to an embodiment of the invention. The image-formation device 202 is depicted as including the memory 206, an image-formation mechanism 402, a detection mechanism 404, and a security mechanism 406. As can be appreciated by those of ordinary skill within the art, the image-formation device 202 may have other components, in addition to and/or in lieu of those depicted in FIG. 4.

The memory 206 is capable of storing a code, as has been described. The image-formation mechanism 402 includes those components of the image-formation device 202 to form images on media, apart from consumable items. For instance, the mechanism 402 may be or include a laser-printing mechanism where the device 202 is a laser-printing device, or an inkjet-printing mechanism where the device 202 is an inkjet-printing device. The image-formation mechanism 402 uses an image-formation device consumable item inserted into the image-formation device 202 to form images on media.

The detection mechanism 404 detects whether an image-formation device consumable item inserted into the image-formation device 202 has a code programmed in a memory thereof. The detection mechanism 404 may in one embodiment be a wireless radio frequency receiver to detect wireless signals broadcast by the consumable item and representative of the code programmed in the memory of the item. The detection mechanism 404 may in another embodiment be a communication bus to interface with a corresponding communication bus of the consumable item to receive the code programmed in the memory of the item. The detection mechanism 404 may further may be another type of detection mechanism.

The security mechanism 406 is to allow the image-formation mechanism 402 to form images on media using the consumable item inserted into the image-formation device 202 where the code programmed into the memory 206 of the device 202 is identical to the code programmed into the memory of the consumable item. The security mechanism 406 is further to allow the image-formation mechanism 402 to form images on media using the consumable item where the consumable item has been detected as not having a code programmed in its memory. Furthermore, the security mechanism 406 is to disallow the image-formation mechanism 402 from using the consumable item to form images on media where the code of the image-formation device 202 is different than the code of the consumable item. The security mechanism 406 may be implemented in software, hardware, or a combination of hardware and software.

Figure 5:
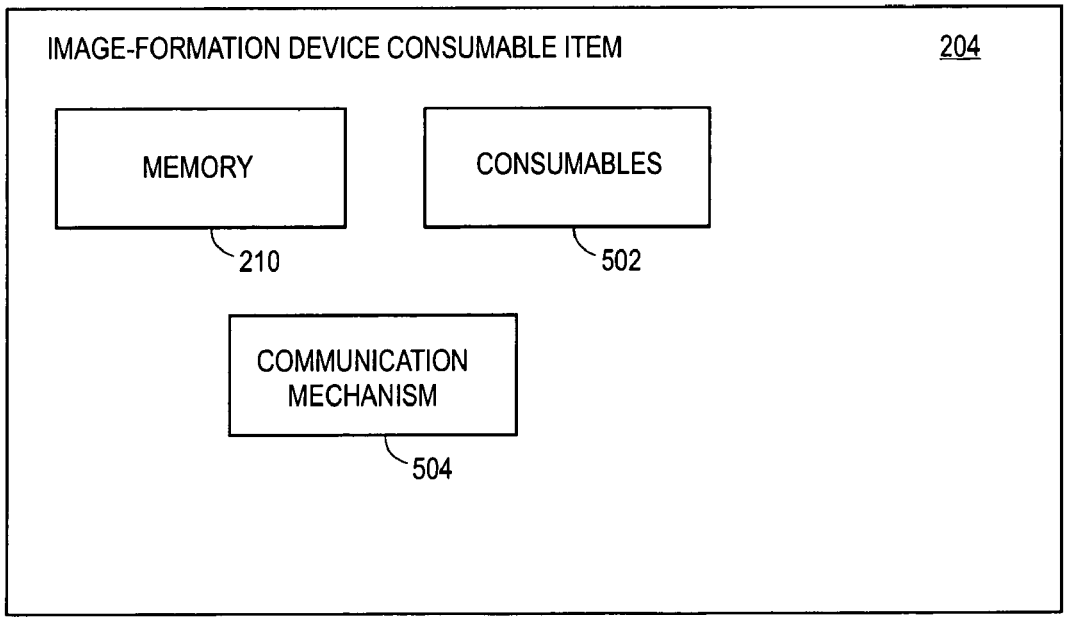
FIG. 5 is a rudimentary block diagram of a particular implementation of an image-formation device consumable item, according to an embodiment of the invention.

FIG. 5 shows a rudimentary block diagram of one implementation of the image-formation device consumable item 204, according to an embodiment of the invention. The image-formation device consumable item 204 is depicted as including the memory 210, one or more consumables 502, and a communication mechanism 504. As can be appreciated by those of ordinary skill within the art, the consumable item 204 may have other components, in addition to and/or in lieu of those depicted in FIG. 5.

The memory 210 is capable of storing a code, as has been described. The consumables 502 include consumables needed and used by an image-formation device to form images on media. The communication mechanism 504 communicates the code programmed in the memory 210 to an image-formation device into which the consumable item 204 has been inserted. The mechanism 504 may be an active communication mechanism, such as a wireless transmitter to broadcast wireless signals representative of the code. The mechanism 504 may further be a passive communication mechanism, such as a communications bus that allows a corresponding communications bus of the image-formation device to read the code from the memory 210.

It is noted that, although specific embodiments have been illustrated and described herein, it will be appreciated by those of ordinary skill in the art that any arrangement is calculated to achieve the same purpose may be substituted for the specific embodiments shown. This application is intended to cover any adaptations or variations of the present invention. Therefore, it is manifestly intended that this invention be limited only by the claims and equivalents thereof.

I claim:

1. A method comprising:

programming a first code into a memory of an image-formation device consumable item, outside of an image-formation device;

upon insertion of the image-formation device consumable item into the image-formation device, detecting that the memory of the consumable item has programmed therein the first code;

determining by the image-formation device whether the first code is identical to a second code programmed into a memory of the image-formation device; and, where the first code is identical to the second code, allowing the consumable item to be used by the image-formation device to form images on media, wherein one or more of:

the method further comprising, in response to detecting that the memory of the consumable item does not have programmed therein the first code, allowing the consumable item to be used by the image-formation device to form images on media; and/or, each of the second code and the first code is associated with a particular party.

2. The method of claim 1, further comprising, where the first code differs from the second code, preventing the consumable item from being used by the image-formation device to form images on media.

3. The method of claim 1, further comprising, in response to detecting that the memory of the consumable item does not have programmed therein the first code, allowing the consumable item to be used by the image-formation device to form images on media.

4. The method of claim 1, wherein programming the memory of the image-formation device consumable item with the first code comprises one of:

programming the memory of the consumable item with the first code by a user of a particular party with which the first code is associated; and, programming the memory of the consumable item with the first code by a merchant upon purchase of the consumable item by the user of the particular party with which the first code is associated.

5. The method of claim 1, further comprising, programming the memory of the image-formation device with the second code.

6. The method of claim 5, wherein programming the memory of the image-formation device with the second code comprises one of programming the memory of the image-formation device with the second code by a user of a particular party with which the second code is associated; and, programming the memory of the image-formation device with the second code by a merchant upon purchase of the image-formation device by the user of the particular party with which the second code is associated.

7. The method of claim 1, wherein each of the second code and the first code is associated with a particular party.

8. The method of claim 1, wherein each of the second code and the first code is capable of being non-unique, such that one or more other image-formation devices are capable of having the same second code, and one or more other image-formation device consumable items are capable of having the same first code.

9. An image-formation device comprising:

a memory capable of having programmed therein a code;

an image-formation mechanism capable of forming images on media using an image-formation device consumable item insertable into the image-formation device;

a detection mechanism to detect whether the consumable item insertable into the image-formation device has a code programmed in a memory thereof other than by the image-formation device; and, a security mechanism to allow the image-formation mechanism to form images on media using the consumable item where the code of the image-formation device is identical to the code of the consumable item, wherein one or more of:

the security mechanism is further to allow the image-formation mechanism to form images on media using the consumable item where the consumable item has been detected as not having a code programmed in the memory thereof and/or, the code of the image-formation device is associated with a particular party.

10. The image-formation device of claim 9, wherein the security mechanism is further to allow the image-formation mechanism to form images on media using the consumable item where the consumable item has been detected as not having a code programmed in the memory thereof.

11. The image-formation device of claim 9, wherein the security mechanism is to disallow the image-formation mechanism from forming images on media using the consumable item where the code of the image-formation device differs from the code of the consumable item.

12. The image-formation device of claim 9, wherein the memory is one of reprogrammable with a new code, and non-reprogrammable.

13. The image-formation device of claim 9, wherein the code of the image-formation device is associated with a particular party.

14. The image-formation device of claim 9, wherein the code of the image-formation device is capable of being non-unique, such that one or more other image-formation devices are capable of having the same code.

15. An image-formation device comprising:

first means for forming images on media using an image-formation device consumable item insertable into the image-formation device;

second means for allowing the first means to form images on media using the consumable item where a code of the image-formation device is identical to a code programmed into the consumable item other than by the image-formation device; and third means for detecting whether the consumable item insertable into the image-formation device has a code programmed therein and for reading the code from the consumable item.

16. The image-formation device of claim 15, wherein the second means is further for disallowing the first means from forming images on media using the consumable item where the code of the image-formation device differs from the code of the consumable item.

17. The image-formation device of claim 15, wherein the code of the image-formation device is associated with a particular party, and is capable of being non-unique, such that one or more other image-formation devices are capable of having the same code.

18. A consumable item for an image-formation device comprising:

one or more consumables to be used by the image-formation device to form images on media;

a memory capable of having programmed therein a code associated with a particular party by other than the image-formation device; and, a communication mechanism to communicate the code to the image-formation device into which the consumable item is insertable, wherein the image-formation device is configured to use the consumables to form images on media where the code is identical to a code of the image-formation device or where the code has not been programmed into the memory, and otherwise is configured not to use the consumables to form images on media.

19. The consumable item of claim 18, wherein the consumables comprise one or more of ink, toner, a colorant, a pigment, a fuser, and a printhead.

20. The consumable item of claim 18, wherein the memory is one of reprogrammable with a new code, and non-reprogrammable.

21. The consumable item of claim 18, wherein the code is capable of being non-unique, such that one or more other consumable items for the image-formation device are capable of having the same code.

22. A consumable item for an image-formation device comprising:

one or more consumables to be used by the image-formation device to form images on media;

means for storing a code associated with a particular party and programmed therein by other than the image-formation device; and, means for communicating the code to the image-formation device into which the consumable item is insertable, wherein the image-formation device is configured to use the consumables to form images on media where the code is identical to a code of the image-formation device or where the code has not been programmed into the memory, and otherwise is configured not to use the consumables to form images on media.

23. The consumable item of claim 22, wherein the code is capable of being non-unique, such that one or more other consumable items for the image-formation device are capable of having the same code.

24. A computer-readable medium of an image-formation device having a computer program stored thereon and executable by the image-formation device, the computer program comprising:

a first computer program part to detect whether a memory of an image-formation device consumable item inserted into the image-formation device has programmed therein a first code, the first code programmed into the memory of the image-formation device by other than the image-formation device;

a second computer program part to determine whether the first code is identical to a second code programmed in the image-formation device; and, a third computer program part to allow the consumable item to be used by the image-formation device to form images on media where the first code is identical to the second code, and to allow the consumable item to be used by the image-formation device to form images on media where the consumable item does not have the first code programmed therein.

25. The computer-readable medium of claim 24, wherein the third computer program part is further to prevent the consumable item from being used by the image-formation device to form images on media where the first code differs from the second code.

* * * * *

UNITED STATES PATENT AND TRADEMARK OFFICE

CERTIFICATE OF CORRECTION

PATENT NO. : 7,221,878 B2
APPLICATION NO. : 11/061238
DATED : May 22, 2007
INVENTOR(S) : Steven H. Chen It is certified that error appears in the above-identified patent and that said Letters Patent is hereby corrected as shown below:

In column 6, line 44, in Claim 6, delete “of” and insert -- of: --, therefor.

In column 7, line 12, in Claim 9, delete “thereof” and insert -- thereof; --, therefor.

In column 7, line 26, in Claim 12, delete “of” and insert -- of: --, therefor.

In column 7, line 43, in Claim 15, delete “and” and insert -- and, --, therefor.

In column 8, line 9, in Claim 19, delete “of” and insert -- of: --, therefor.

In column 8, line 12, in Claim 20, delete “of” and insert -- of: --, therefor.

Signed and Sealed this

Twenty-sixth Day of August, 2008

JON W. DUDAS
*Director of the United States Patent and Trademark Office*